United States Patent [19]

Stoll

[11] 4,346,272

[45] Aug. 24, 1982

[54] CONTROL DEVICE AND METHOD OF OPERATING

[75] Inventor: Donald H. Stoll, Morrison, Ill.

[73] Assignee: General Electric Company, Fort Wayne, Ind.

[21] Appl. No.: 141,689

[22] Filed: Apr. 18, 1980

[51] Int. Cl.[3] ..... H01H 35/34; H01H 1/26

[52] U.S. Cl. ..... 200/83 C; 200/153 A; 200/283; 200/835

[58] Field of Search ..... 200/83 C, 83 S, 153 V, 200/159 A, 245, 246, 275, 283, 340

[56] References Cited

U.S. PATENT DOCUMENTS

| | | | |
|---|---|---|---|
| 2,284,644 | 6/1942 | Dubilier | 200/283 |
| 2,546,471 | 3/1951 | Myers | 337/378 |
| 2,574,869 | 11/1951 | Green | 337/88 |
| 3,015,002 | 12/1961 | Laviana | 200/283 |
| 3,062,932 | 11/1962 | Korsgren et al. | 200/283 |
| 3,117,205 | 1/1964 | Adams | 337/390 |
| 3,185,803 | 5/1965 | Driscoll | 200/159 A |
| 3,789,339 | 1/1974 | Wehl | 337/95 |

*Primary Examiner*—John W. Shepperd
*Attorney, Agent, or Firm*—Joseph E. Papin

[57] ABSTRACT

A control device for an electrical circuit has switch means adapted for movement between circuit making and breaking positions including means for stiffening the switch means having a force receiving end spaced therefrom. Fulcrum means is disposed for pivoting engagement with the switch means. Means is operable for applying a control force onto the force receiving end of the stiffening means so as to yield the switch means in its circuit making position into pivotal engagement with the fulcrum means and thereafter pivotally move a part of the switch means about the fulcrum means toward the circuit breaking position.

A method of operating a control device is also disclosed.

35 Claims, 5 Drawing Figures

CONTROL DEVICE AND METHOD OF OPERATING

FIELD OF THE INVENTION

This invention relates in general to electrical mechanisms and in particular to a control device for an electrical circuit and a method of operating a control device.

BACKGROUND OF THE INVENTION

In the past, various different control devices, such as an aneroid switch or the like for instance, were utilized in an electrical circuit of an automotive vehicle to control the energization of a computer or the like which, in turn, controlled the amount of fuel injected or otherwise supplied to the carburetor of the automotive vehicle as it was driven to different altitudes.

Many of these past control devices were of the "creep-type" which utilized a slow make and break switch comprising a resilient switch blade having a movable contact thereon urged into making engagement with a stationary contact in such control device so as to complete an electrical circuit therethrough. Of course, the resiliency of the switch blade or its biasing effect on the movable contact thereof dictated or controlled the engagement force between such movable contact and the stationary contact. An actuator for the past "creep-type" control devices was operable generally in response to a change in a preselected parameter, such as fluid pressure, temperature, atmospheric pressure or the like for instance, and in response to such preselected parameter change, the actuator was movable to apply an increasing force onto the resilient switch blade. In response to this applied force acting on the resilient switch blade, such switch blade was pivoted or otherwise moved toward a displaced position breaking the movable contact thereon from the stationary contact so as to interrupt the circuit through the control device. One of the disadvantageous or undesirable features of such past "creep-type" control devices is believed to be that the engagement or contact force between the movable and stationary contacts started to decrease well in advance of the actual switching point thereof when the movable contact was broken from the stationary contact. An analogous disadvantageous or undesirable feature is believed to be that the slow make and break switch of the past "creep-type" control device was very susceptible to contamination and vibration as the movable contact of the switch blade approached its switching point with respect to the stationary contact.

SUMMARY OF THE INVENTION

Among the several objects of the present invention may be noted the provision of an improved control device and an improved method of operating a control device which overcomes the disadvantageous or undesirable features discussed hereinbefore, as well as others, with respect to the prior art; the provision of such improved control device and method in which the contact force between a pair of contacts of a switch mechanism is increased upon actuation of such switch mechanism until just prior to the switching point thereof when such contacts are broken from each other; the provision of such improved control device and method in which a resilient switch blade of such switch mechanism is actuated into engagement with a fulcrum and with at least a part of the switch blade being then pivoted about the fulcrum to effect the breaking of the contacts; the provision of such improved control device and method in which the fulcrum in adjustably movable with respect to the resilient switch blade; and the provision of such improved control device and method in which the components thereof are simplistic in design, easily assembled and economically manufactured. These as well as other objects and advantageous features of the present invention will be in part apparent and in part pointed out hereinafter.

In general and in one form of the invention, a control device for an electrical circuit has a housing with a chamber therein. A resilient switch means is pivotally mounted within the chamber for movement between circuit making and breaking positions, and the switch means includes means for stiffening it with the stiffening means having a force receiving end spaced from the switch means. Fulcrum means is disposed in the chamber for pivotal engagement with the switch means. Means in the chamber is operable generally for applying a control force onto the force receiving end of the stiffening means. The switch means in its circuit making position is initially yieldable in response to the control force applied onto the stiffening means into the pivotal engagement with the fulcrum means, and a part of the switch means is thereafter pivotally movable about the fulcrum means toward the circuit breaking position in response to the control force applied onto the stiffening means.

Further in general and in one form of the invention, a method is provided for operating a control device adapted for connection in an electrical circuit. The control device has a fulcrum, yieldable switch means having a preselected assembly position adapted for completing the circuit through the control device, and means secured to a part of the switch means for stiffening it with the stiffening means having a free end portion spaced from the switch means. In this method, an applied force is exerted onto the free end portion of the stiffening means, and the switch means is yielded in its preselected assembly position into engagement with the fulcrum. The switch means part is pivoted in response to the applied force acting on the stiffening means generally about the engagement of the switch means with the fulcrum, and the switch means part is displaced pivotally toward a position adapted to interrupt the circuit through the control device.

BRIEF DESCRIPTION OF THE DRAWINGS

Corresponding reference characters indicate corresponding parts throughout the several views of the drawings.

The exemplifications set out herein illustrate the preferred embodiment of the present invention in one form thereof, and such exemplification are not to be construed as limiting the scope of the present invention in any manner.

DETAILED DESCRIPTION OF THE PREFERRED EMBODIMENT

Figure 2:
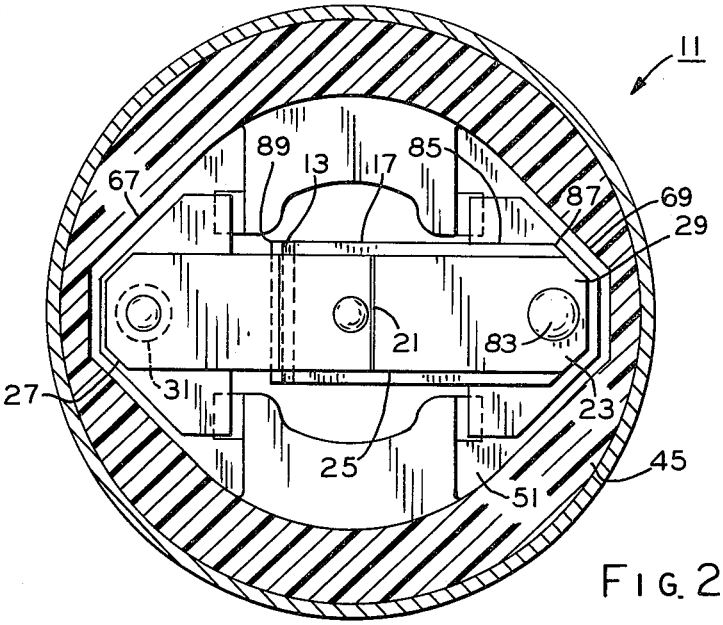
FIG. 2 is a sectional view taken along line "2—2" of FIG. 1.
Figure 1:
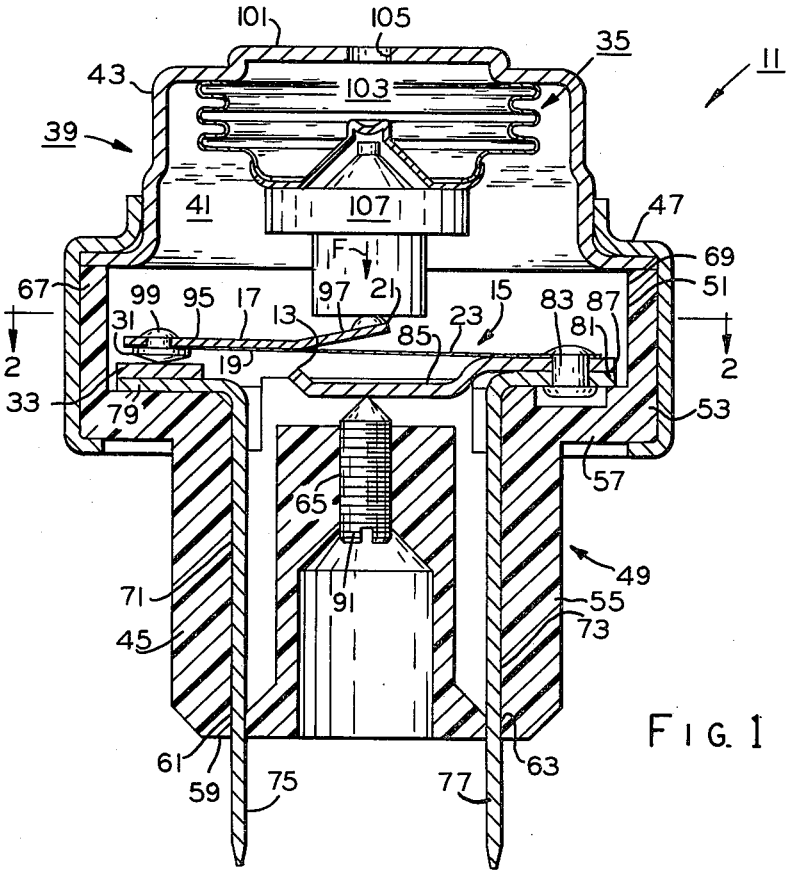
FIG. 1 is a sectional view illustrating a control device in one form of the invention in cross-section and also illustrating principles which may be utilized in a method of operating a control device in one form of the invention.
Figure 4:
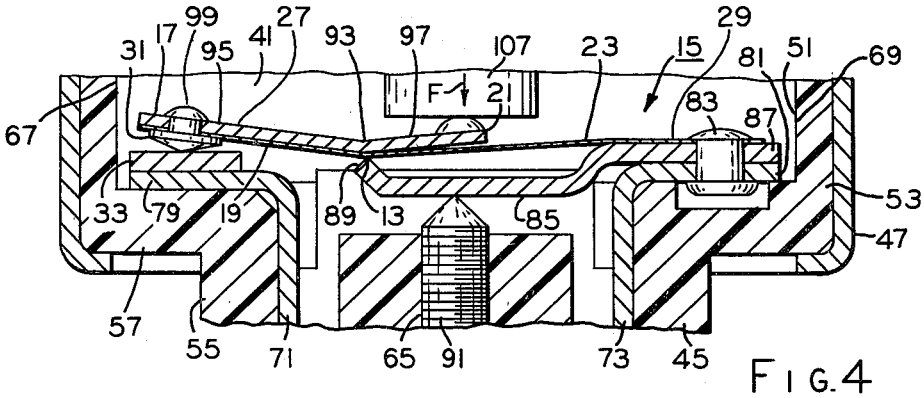
FIG. 4 is a partial sectional view taken from FIG. 1 illustrating the pivotal engagement between a yieldable switch blade and a fulcrum therefor of the control device of FIG. 1.
Figure 5:
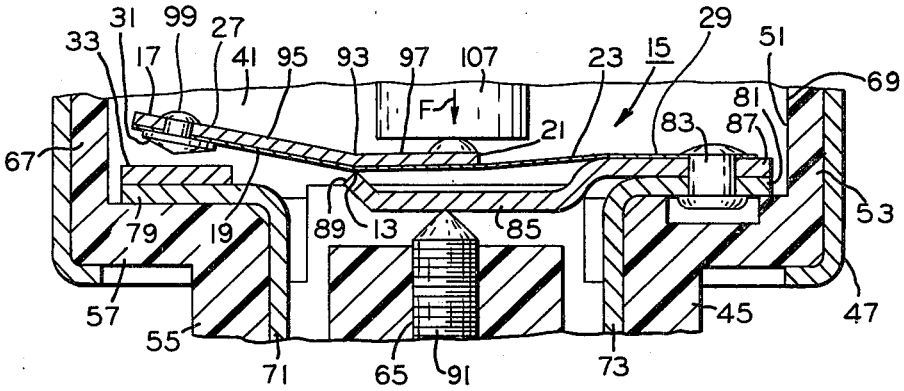
FIG. 5 is another partial sectional view taken from FIG. 1 illustrating the switch blade in its displaced or circuit interrupting position.

Referring now to the drawings in general, there is illustrated in one form of the invention a method of operating a control device 11, such as an aneroid switch or the like for instance, adapted for connection in an electrical circuit (not shown). Control device 11 has a fulcrum or fulcrum means 13, and in a preselected assembly position or circuit making position, a yieldable switch means or mechanism 15 of the slow make and break type is adapted for completing the circuit through control device 11 (FIG. 1). Means, such as a generally rigid strip or member 17 or the like for instance, is secured to a part 19 of switch means 15 for stiffening it, and the stiffening means or strip 17 has a force receiving or free end portion 21 spaced from or at least generally adjacent the switch means (FIGS. 1, 2 and 5). In this method, an applied or control force, as indicated by the arrow F, is exerted onto free end portion 21 of stiffener or strip 17, and switch means 15 is yielded or otherwise moved while in its at rest or preselected assembly position into engagement with fulcrum 13 (FIG. 4). Switch means part 19 is then pivoted in response to the control force F acting on stiffener 17 generally about the engagement of switch means 15 with fulcrum 13, and the switch means part is displaced or otherwise pivotally moved toward a position adapted to interrupt the circuit through control device 11 (FIG. 5).

More particularly and with specific reference to FIG. 1, switch means 15 includes a resilient or yieldable switch blade or element 23 which may be formed from a material having desired or preselected resilient and electrical conductive properties, such as a beryllium copper or the like for instance. Switch blade 23 has an intermediate portion 25 integrally formed or interposed between a pair of opposite ends or end portions 27, 29, and a movable contact 31 of a contact pair 31, 33 is secured to opposite or free end 27 of the switch blade while the other or stationary contact 33 is disposed in control device 11 for circuit making and breaking engagement with movable contact 29. At least part 19 of switch means 15 includes at least opposite end 27 of the switch means. In the preselected assembly position or circuit making position of switch means 15 opposite end 29 of switch blade 23 is pivotally secured or otherwise mounted, as discussed in greater detail hereinafter, and the resiliency of the switch blade urges movable contact 31 thereon into making engagement with stationary contact 33 so as to establish a preselected contact or engagement force therebetween.

Means, such as a bellow or other actuator 35 or the like for instance, is operable generally in control device 11 for exerting or otherwise applying control force F onto free end 21 of stiffener 17, and control force F is transferred or otherwise transmitted from the stiffener to switch blade 23 in the preselected assembly position thereof. Upon this transfer of control force F to switch blade 23 in the preselected assembly position thereof, the switch blade yields so that intermediate portion 25 thereof is moved into pivotal engagement with fulcrum 13, as best seen in FIG. 4. As may be noted from the contact force-actuator movement plot or curve 37 in FIG. 3, control force F starts to act on switch blade 23 at point A of curve 37, and at point B, the switch blade contacts fulcrum 13, as discussed above. Thus, it may be noted that between points A and B on curve 37, the contact force between contacts 31, 33 is increased thereby decreasing the possibility of contact chattering which may be effected by vibration or impact and also contact making interference which may be effected by the presence of contamination or foreign particles between such contacts. Upon further increase of the control force F when switch blade 23 is engaged with fulcrum 13, at least the part 19 of switch blade 23 is pivoted generally about the engagement of the switch blade with fulcrum 13 toward a pivoted or displaced position breaking movable contact 31 from stationary contact 33 so as to interrupt the circuit through control device 11, as best seen in FIG. 5. Because stiffener 17 has a very high spring gradient, contacts 31, 33 are broken, as discussed above, with very little additional increase in control force F as correlated with movement of bellows 35 and as illustrated between points B and C on curve 37 in FIG. 4 with point C, of course, representing the switching point at which the contacts are broken from each other.

Referring again in general to the drawings and recapitulating at least in part with respect to the foregoing, control device 11 is shown in one form of the invention having a housing 39 with an atmospheric pressure chamber 41 therein (FIG. 1). Switch means 15 is pivotally mounted within chamber 41 for movement between circuit making and breaking positions, and the switch means includes stiffener 17 having free end portion 21 thereof spaced from or arranged at least adjacent the switch means (FIGS. 1, 4 and 5). Fulcrum 13 is disposed in chamber 41 at least adjacent switch means 15 for the pivotal engagement with switch means. Bellows 35 is operable generally for applying control force F onto free end portion 21 of stiffener 17 (FIG. 1). Switch means 15 in its circuit making position is initially yieldable in response to the control force F applied onto free end portion 21 of stiffener 17 into the pivotal engagement with fulcrum 13, and switch means part 19 is thereafter pivotally movable about the fulcrum toward the displaced or circuit breaking position in response to the control force F acting on the switch means (FIGS. 4 and 5).

Figure 3:
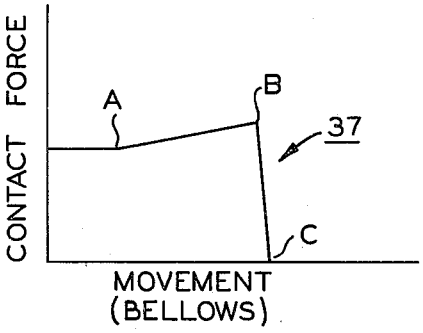
FIG. 3 is a graphical representation illustrating contact force plotted against actuator movement for the control device of FIG. 1.

More particularly and with specific reference to FIGS. 1–3, housing 39 comprises a pair of upper and lower housing members 43, 45 abutted together so as to define chamber 41 therein, and the housing members are retained against displacement from each other by suitable means, such as for instance, a circumferential generally annular band 47 extending about the housing members in gripping engagement therewith. Lower housing member 45 is formed of a suitable dielectric material, and upper housing 43 may be formed of a suitable metallic material, if desired. Of course, it is contemplated that other housing members having different shapes, being formed of different materials, and being retained against displacement by other suitable means may be utilized within the scope of the invention so as to meet the objects thereof.

Lower housing portion 45 is provided with a plurality of wall means 49 defining a generally central opening 51 therein and includes at least a pair of generally cylindric stepped walls 53, 55 with an integral generally radially extending wall defining an annular shoulder 57 therebetween. The lower end of the smaller stepped wall 55 is provided with an integral transverse end or closure wall 59 having a pair of spaced apart terminal receiving slots 61, 63 and a generally centrally located threaded aperture or opening 65 extending therethrough between the terminal receiving slots. A pair of opposed notches 67, 69 are also provided in larger stepped wall 53 between the upper end thereof and shoulder 57.

A pair of opposite spaced apart terminals or terminal means 71, 73 are fixedly arranged on smaller stepped wall 55 and shoulder 57 of lower housing member 45 within opening 51 thereof, and the terminals have electrical connector sections 75, 77 extending through terminals slots 61, 63 in closure wall 59 of the lower housing member exteriorly thereof. Terminals 71, 73 also include switch means supporting sections or interior flanges 79, 81 which overlay shoulder 57 of lower housing member 45 within opening 51 thereof so as to extend generally into notches 67, 69, and stationary contact 33 is mounted to or otherwise carried on interior flange 77 of terminal 71. Opposite end 29 of switch blade 23 is pivotally connected or otherwise secured by suitable means, such as a rivet 83 or the like for instance, to interior flange 81 of terminal 73, and in the preselected assembly position, the switch blade spans or extends generally across opening 51 or chamber 41 so as to bias or otherwise urge movable contact 31 carried on opposite end portion 27 of the switch blade into circuit making engagement with stationary contact 33 on terminal 71.

A cantilevered member or abutment finger 85 may be formed from suitable metallic strip material having preselected resilient characteristics. Finger 85 includes a pivot end 87 sandwiched or otherwise interposed between opposite or pivoted end portion 29 of switch blade 23 and interior flange 81 of terminal 73 so as to be secured therebetween by rivet 83. While pivot end 87 of finger 85 is abutted between switch blade 23 and terminal 73, as discussed above, the finger extends partially across opening 51 of lower housing 45 in adjacent spaced relation with the switch blade, and a free end 89 of the finger opposite the pivot end thereof is bent or otherwise deformed so as to present or otherwise provide an edge thereof generally adjacent switch blade 23 for the pivotal engagement therewith with such edge defining fulcrum 13. It may be noted that fulcrum 13 is predeterminately located or spaced closer to opposite end portion 27 of the switch blade than to pivoted end 29 thereof.

Adjusting means, such as a set screw 91 or the like for instance, is adjustably or threadedly received in threaded aperture 65 provided therefor in closure wall 59 of lower housing member 45, and the adjusting means or set screw is adapted for adjusting fulcrum 13 with respect to switch blade 23. Thus, when rotated in threaded engagement with threaded aperture 65, set screw 91 engages and drives cantilevered finger 85 about its pivot end 87 so as to adjustably locate fulcrum 13 in a desired or preselected spaced relation with switch blade 23 when the switch blade is in the preselected assembly position thereof.

Stiffener or lever 17 may be formed from suitable metallic strip material having high spring gradient characteristics so as to be, in effect, generally rigid. Stiffener 17 is bent or otherwise deformed generally at 93 so as to comprise on opposite sides of bend 93 a pair of oppositely extending and angularly disposed arms or lever arms 95, 97. Stiffener arm 95 is arranged at least in part generally in overlaying relation with switch blade 23 and is fixedly secured or otherwise attached thereto by suitable means, such as for instance by swagging over or otherwise deforming an integrally formed rivet part 99 of contact 31 into gripping engagement with stiffener arm 95. Thus, opposite end portion 27 of switch blade 23 is sandwiched or otherwise interposed in abutment between contact 31 and stiffener arm 95. Because stiffener arm 95 extends generally coextensively in overlaying relation with switch blade 23, stiffener arm 97 extends generally in angular spaced relation with the switch blade, and the free end portion of stiffener arm 97 defines force receiving end 21 of stiffener 17 which is, as previously mentioned, spaced from the switch blade. With stiffener 17 so secured in the overlaying relation thereof with switch blade 23, it may be noted that bend 93 in the stiffener is predeterminately located generally vertically above fulcrum 13, and force receiving end 21 of the stiffener is disposed between the fulcrum and pivoted end 87 of switch blade 23. Therefore, when switch blade 23 is yielded in its assembly position into pivotal engagement with fulcrum 13, as previously discussed, stiffener bend 93 is located generally on or at least closely adjacent the fulcrum with, of course, the switch blade being interposed therebetween.

Bellows 35 is secured to an upper end wall 101 of upper housing member 43 by suitable means, such as for instance welding or soldering or the like (not shown), and extends downwardly from the upper end wall into chamber 41. A vacuum chamber 103 is defined within bellows 35 between it and upper end wall 101 of upper housing member 43, and a control port 105 is provided through the upper end wall communicating with the bellows chamber. To complete the description of the control device 11, a push rod or plunger 107 is interposed or otherwise abutted between the lower or free end of bellows 33 and force receiving end 21 of stiffener 17.

In the operation of control device 11 assume that the component parts thereof are assembled and disposed in the positions thereof illustrated in FIG. 1, and also that chamber 103 of bellows 35 has been evacuated through control port 105 thereby to effect a partial vacuum within the bellows chamber. Thus, because housing chamber 41 is subjected to the ambient or atmospheric pressure and a partial vacuum prevails in bellows chamber 103, a pressure differential is established across bellows 35 acting in a direction (i.e., generally upwardly or vertically as seen in FIG. 1) to prevent the actuation of switch means 15 by the bellows.

In the event of reduction in the atmospheric pressure as may be occasioned in the event an automotive vehicle in which control device 11 may be utilized is driven to a higher altitude for instance, the magnitude of the pressure differential across bellows 35, of course, is reduced, and as a result of such reduced pressure differential, the bellows will move or extend thereby to drive push rod 107 downwardly (as seen in FIG. 1) and exert control force F upon force receiving end 21 of stiffener 17 to effect the actuation or operation of switch means 15. When control force F is so applied onto stiffener 17, control force F is transmitted or otherwise transferred through the stiffener to switch blade 23 in its preselected assembly position causing it to yield, deflect or otherwise be driven into the abutting or pivoting engagement with fulcrum 13, as seen in FIG. 4. It may be noted that even though switch blade 23 yields in its preselected assembly position, as discussed above, contacts 31, 33 remain closed or made wherein switch means 15 completes the electrical circuit through control device between terminals 71, 73 thereof. It may also be noted that the yielding of switch blade 23 in response to control force F acting thereon effectively increases the contact force between contacts 31, 33, as illustrated between points A, B in curve 37 of FIG. 3 and as previously mentioned.

In the event of a further reduction of the pressure differential acting across bellows 35, the bellows will, of course, further extend or move downwardly into housing chamber 41 thereby to increase the magnitude of control force F exerted on switch blade 23 through stiffener 17 when the switch blade is seated or otherwise disposed in the pivotal engagement thereof with fulcrum 13. When the increased control force F is exerted onto force receiving end 21 of stiffener 17, the stiffener and the switch blade part 19 are pivoted about fulcrum 13 thereby to move contact 13 toward its displaced position breaking it from stationary contact 33 on terminal 71. Upon the breaking of contacts 31, 33, the electrical circuit through control device 11 is, of course, interrupted, as seen in FIG. 5.

When the pressure differential across bellows 35 is increased, the bellows contracts in response thereto and moves upwardly within housing chamber 41 thereby to eliminate control force F exerted upon stiffener 17. Upon the elimination of the control force F, the component parts of control device 11 will return to their original positions, as illustrated in FIG. 1.

While control device 11 and its operation has been discussed hereinabove in the context of a vacuum-atmospheric pressure differential operated aneroid switch, it is contemplated that the fluid pressure differential actuated bellows 35 may be replaced by a positive type fluid pressure operated actuator so as to effect similar operation of switch means 15 within the scope of the present invention so as to meet the objects and advantageous features thereof.

In view of the foregoing, it is now apparent that a novel control device 11 and a method of operating such have been presented meeting the objects set out herein, as well as others, and it is contemplated that changes as to the precise arrangements, shapes, details and connections of the component parts and also the precise order of the method steps illustrated herein may be made by those having ordinary skill in the art without departing from the spirit of the invention or the scope thereof as set out in the claims which follow.

What I claim as new and desire to secure by Letters Patent of the United States is:

1. A control device for an electrical circuit comprising:

a housing;

a chamber within said housing;

a pair of spaced apart terminals disposed in said housing, said terminals respectively including a pair of electrical connection sections exteriorly of said housing and adapted to be connected in the electrical circuit, and a pair of switch means supporting sections within said chamber;

switch means arranged within said chamber between said terminals and adapted for completing and interrupting the electrical circuit, said switch means including a pair of contacts, one of said contacts being arranged on one of said supporting sections of one of said terminals, a resilient switch blade adapted to carry current spanning at least a part of said chamber between said supporting sections of said terminals and having an intermediate portion integrally interposed between a pair of opposite end portions, one of said opposite end portions being pivotally mounted to the other of said supporting sections of the other of said terminals, the other of said contacts being arranged on the other of said opposite end portions and engageable with said one contact, a switch blade stiffener arranged at least in part generally in overlaying relation with said switch blade, said stiffener being connected with said switch blade at least adjacent said other opposite end thereof and said stiffener having a force receiving end disposed at least adjacent said intermediate portion of said switch blade;

fulcrum means disposed within said chamber for pivoting engagement with said intermediate portion of said switch blade;

means movable in said housing for adjusting said fulcrum means with respect to said switch blade;

a bellows movably secured to said housing within said chamber;

another chamber defined within said bellows between said bellows and said housing;

a push rod interposed between said bellows and said force receiving end of said stiffener; and a control port in said housing and communicated with said another chamber, said bellows being responsive to a pressure differential between said first named chamber and said another chamber to move said push rod against said force receiving end of said stiffener so as to apply a force thereon, said switch blade being initially yieldable in response to the applied force acting on said stiffener to pivotally engage said intermediate portion of said switch blade with said fulcrum means and to increase the force of the engagement between said one and other contacts and said switch blade being thereafter further pivotally movable about said fulcrum means in response to the applied force acting on said stiffener to effect the disengagement of said other contact on said switch blade from said one contact on said one supporting section of said one terminal so as to interrupt the circuit.

2. A control device for an electrical circuit comprising:

a housing having a chamber therein;

resilient switch means pivotally mounted within said chamber and adapted for movement between circuit making and breaking positions, said switch means including means for stiffening it with said stiffening means having a force receiving portion disposed at least adjacent said switch means;

fulcrum means disposed in said chamber for pivoting engagement with said switch means; and means in said chamber and operable generally for applying a control force onto said force receiving portion of said stiffening means, said switch means in its circuit making position being initially resiliently yieldable in response to the control force applied onto said stiffening means into the pivotal engagement with said fulcrum means and at least a part of said switch means being thereafter pivotally movable generally about said fulcrum means toward the circuit breaking position in response to the control force applied onto said stiffening means.

3. A control device as set forth in claim 2 further comprising means movable in said housing for adjusting said fulcrum means with respect to said switch means.

4. A control device as set forth in claim 2 wherein said switch means includes an intermediate portion integrally interposed between a pair of opposite end portions, one of said opposite end portions being pivotally secured within said chamber, and said at least part of said switch means including at least the other of said opposite end portions.

5. A control device as set forth in claim 4 wherein said intermediate portion is engaged with said fulcrum means upon the initial resilient yielding of said switch means in the circuit making position thereof.

6. A control device as set forth in claim 5 wherein the engagement between said fulcrum means and said intermediate portion is spaced in closer relation with said other opposite end portion than with said one opposite end portion.

7. A control device as set forth in claim 5 wherein the force receiving portions of said stiffening means is spaced generally between said one opposite end portion and the pivotal engagement of said intermediate portion with said fulcrum means.

8. A control device for an electrical circuit comprising:

a housing;

a chamber in said housing;

a yieldable switch blade disposed in a circuit completing position within said chamber, said switch blade including one end portion pivotally secured within said chamber, and a free end portion opposite said one end portion and with said free end portion being pivotally movable toward a position adapted to interrupt the circuit;

means secured to said switch blade at least generally adjacent said free end portion thereof and extending at least in part generally in overlaying relation with said switch blade for stiffening it, said stiffening means including a force receiving portion at least adjacent said switch blade between said one end portion and said free end portion thereof;

fulcrum means disposed in said chamber for pivotal engagement with said switch blade; and means operable generally for applying a control force onto said force receiving portion of said stiffening means, said switch blade in the circuit completing position thereof being initially yieldable in response to the control force applied onto said force receiving portion of said stiffening means into the pivotal engagement with said fulcrum means and at least said free end portion of said switch blade being thereafter pivotally movable toward its position adapted to interrupt the circuit generally about the engagement of said switch blade with said fulcrum means in response to the control force applied onto said force receiving portion of said stiffening means.

9. A control device as set forth in claim 8 further comprising a pair of terminals spaced apart in said housing, said terminals respectively including a pair of electrical connector sections extending exteriorly of said housing and adapted to be connected in the circuit, and a pair of supporting sections within said chamber, said one end portion of said switch blade being pivotally secured in electrical conductive relation with one of said supporting sections, and the free end portion of said switch blade in the circuit completing position thereof being arranged in electrical conductive relation with the other of said supporting sections.

10. A control device as set forth in claim 8 further comprising means movable in said housing for adjustably locating said fulcrum means with respect to said switch blade.

11. A control device as set forth in claim 8 further comprising a control port in said housing and communicated with said control force applying means.

12. A control device as set forth in claim 8 wherein said stiffening means comprises a rigid strip having a pair of angularly disposed arm portions, one of said arm portions being secured in the at least in part overlaying relation with said switch blade at least generally adjacent said free end portion thereof and the other of said arm portions extending in a generally angular relation with respect to said switch blade between said free end portion and said one end portion thereof, said force receiving portion being on said other arm portion.

13. A control device as set forth in claim 8 further comprising a pair of relatively movable contact means for engagement with each other when said switch blade is in the circuit completing position thereof, one of said contact means being arranged on said free end portion of said switch blade and the other of said contact means being disposed within said chamber, and the force of the engagement between said contact means being increased at least during the initial yielding of the switch blade in response to the control force applied onto said force receiving portion of said stiffening means.

14. A method of operating a control device adapted for connection in an electrical circuit, the device having a fulcrum, a pivotally mounted yieldable switch blade having a circuit completing position adapted to complete the electrical circuit through the device, a stiffener secured to the switch blade and having a free end portion disposed adjacent the switch blade, the method comprising the steps of:

exerting an applied force onto the free end portion of the stiffener when the switch blade is in its circuit completing position;

yielding the switch blade while in its circuit completing position in response to the applied force exerted on the free end portion of the stiffener and moving the switch blade in response to the yielding thereof into pivotal engagement with the fulcrum;

increasing the applied force exerted on the free end portion of the stiffener when the switch blade is in the pivotal engagement thereof with the fulcrum; and pivotally displacing generally about the fulcrum both a part of the switch blade and the stiffener so as to move the at least switch blade part toward a displaced position adapted to interrupt the circuit through the device upon the increase in the applied force exerted on the free end portion of the stiffener.

15. A method of operating a control device adapted for connection in an electrical circuit, the device having a fulcrum, yieldable switch means having a circuit completing position adapted to complete the circuit through the control device, means secured to the switch means for stiffening the switch means and having a free end portion adjacent said switch means, the method comprising the steps of:

exerting an applied force onto the free end portion of said stiffening means and yielding the switch means in response to the applied force on the free end portion of the stiffening means and while the switch means is in its circuit completing position into engagement with the fulcrum; and pivoting both at least a part of the switch means and the stiffening means in response to the applied force acting on the stiffening means generally about the engagement of the switch means with the fulcrum and displacing thereby the at least switch means part to a position adapted to interrupt the circuit through the device.

16. The method as set forth in claim 14 comprising the preliminary step of adjusting the fulcrum into an adjusted position in predetermined spaced relation with the switch blade thereof.

17. The method as set forth in claim 15 comprising the preliminary step of adjusting the fulcrum into a preselected position generally adjacent the switch blade.

18. A method of operating a control device adapted for connection in an electrical circuit, the device including a pair of relatively movable contact means for making and breaking the electrical circuit, a resilient switch element having a mounted end portion and a movable end portion opposite thereto with one of the contact means being disposed on the movable end portion, a stiffener secured to the switch blade at least generally adjacent the movable end portion thereof and having a force receiving portion generally adjacent the switch element between the mounted end portion and the movable end portion thereof, and fulcrum means for engagement with the switch element, the method comprising the steps of:

exerting a force on the force receiving portion of the stiffener when the one contact means on the movable end portion of the switch element is made with the other of the contact means;

displacing conjointly the stiffener and at least a part of the switch element at least generally between the mounted end portion and the movable end portion thereof toward the fulcrum in response to the force exerted on the force receiving portion of the stiffener and increasing thereby the making force between the one contact means and the other contact means;

engaging the at least part of the switch element with the fulcrum and terminating thereby the conjoint displacement of the stiffener and the at least part of the switch element while maintaining the one contact means made with the other contact means;

increasing the force exerted on the force receiving portion of the stiffener when the at least part of the switch element is engaged with the fulcrum and with the one contact means made with the other contact means; and pivoting conjointly at least the free end portion of the switch element and the stiffener generally about the engagement of the at least part of the switch element with the fulcrum in response to the increased force exerted on the force receiving portion of the stiffener and breaking the one contact means on the free end portion of the switch element from the other contact means.

19. The method as set forth in claim 18 comprising the preliminary step of biasing the switch element to make the one contact means on the movable end portion of the switch element with the other contact means.

20. The method as set forth in claim 18 comprising the preliminary step of adjusting the fulcrum to a preselected position generally adjacent the at least part of the switch element.

21. The method as set forth in claim 20 wherein the preliminary step further comprises applying an adjusting force onto the fulcrum to effect its adjustment into the preselected position generally adjacent the at least part of the switch element.

22. The method as set forth in claim 18 wherein the device further includes means operable generally for exerting the force on the force receiving end of the stiffener and wherein the exerting step includes actuating the force exerting means.

23. The method as set forth in claim 18 wherein the pivoting and breaking step includes moving the force receiving portion of the stiffener toward the switch element.

24. A method of operating a control device adapted for connection in an electrical circuit, the device including a resilient switch element having a pivotally mounted end portion and a movable end portion generally opposite thereto, a contact supported in the device, another contact on the movable end portion of the switch element arranged to make with the first named contact and break therefrom, a fulcrum, and means secured to the switch element at least generally adjacent the movable end portion of the switch element for stiffening the switch element and also having a force receiving portion adjacent the switch element generally between the pivotally mounted end portion and the movable end portion thereof; the method comprising the steps of:

moving conjointly the stiffening means and at least a part of the switch element generally between the pivotally mounted end portion and the movable end portion thereof when the another contact on the movable end portion of the switch element is made with the first named contact and engaging the at least switch element part with the fulcrum; and pivoting conjointly the stiffening means and at least the movable end portion of the switch element generally about the engagement of the at least switch element part with the fulcrum and breaking the another contact on the movable end portion of the switch element from the first named contact.

25. The method as set forth in claim 24 comprising the preliminary step of exerting a force on the force receiving portion of the stiffening means to effect the moving and engaging step.

26. The method as set forth in claim 25 comprising the intermediate step of increasing the force exerted on the force receiving portion of the stiffening means to effect the pivoting and breaking step.

27. The method as set forth in claim 24 comprising the preliminary step of biasing the switch element to make the another contact on the movable end portion of the switch element with the first named contact supported in the device.

28. The method as set forth in claim 24 comprising the preliminary step of adjusting the fulcrum to a preselected adjusted position generally adjacent the at least switch element part.

29. The method as set forth in claim 24 wherein the pivoting and breaking step includes moving the force receiving portion of the stiffening means at least generally adjacent the at least switch element part.

30. A control device adapted for connection in an electrical circuit comprising:

a housing;

a fulcrum in said housing;

resilient switch means in said housing and operable generally between circuit making and breaking positions for controlling the circuit; and means arranged in said housing at least in part in overlaying engagement with a part of said switch means for stiffening it and including a force receiving portion disposed at least generally adjacent said switch means, said stiffening means and said switch means while in its circuit making position being initially conjointly movable in response to an applied force on said force receiving portion of said stiffening means to engage said switch means with said fulcrum, and said stiffening means and at least said switch means part being thereafter conjointly pivoted generally about the engagement of said switch means with said fulcrum in response to an increase in the applied force on the force receiving portion of said stiffening means to effect the displacement of at least said at least switch means part toward the circuit breaking position of said switch means.

31. A control device as set forth in claim 30 further comprising means associated with said housing and operable generally for exerting the applied force onto said force receiving portion of said stiffening means.

32. A control device as set forth in claim 30 further comprising a pair of relatively movable contacts, one of said contacts being supported in said housing and the other of said contacts being disposed on the switch means part, said contacts being made when said switch means is in its circuit making position and being broken upon the displacement of said at least switch means part toward the circuit breaking position of said switch means.

33. A control device adapted for connection in an electrical circuit comprising:

a housing;

a first contact supported in said housing;

a resilient switch element in said housing and including a pair of generally opposite end portions, one of said opposite end portions being pivotally mounted within said housing, and a second contact mounted to said switch element at least generally adjacent the other of said opposite end portions thereof and arranged in making engagement with said first contact;

fulcrum means disposed in said housing for engagement with said switch element generally between said opposite end portions thereof; and means secured at least adjacent said other opposite end portion of said switch element for stiffening said switch element and extending at least in part in overlaying engagement with a part of said switch element, and said stiffening means including a force receiving portion disposed at least generally adjacent said switch means between said opposite end portions thereof, said stiffening means and said switch element being initially conjointly movable in response to an applied force acting on said force receiving portion of said stiffening means to engage said switch element with said fulcrum means when said second contact is in making engagement with said first contact, and said stiffening means and said at least switch means part being thereafter conjointly pivoted generally about the engagement of said switch element with said fulcrum means in response to an increase in the applied force acting on said force receiving portion of said stiffening means to effect the breaking of said second contact from said first contact.

34. A control device as set forth in claim 33 further comprising means associated with said housing and operable generally for exerting the applied force on said force receiving portion of said stiffening means.

35. A control device as set forth in claim 33 further comprising means associated with said housing for adjusting said fulcrum means into a preselected adjusted position with respect to said switch element thereby to adjustably define the movement of said switch element into engagement with said fulcrum means.

* * * * *